US008448488B2

(12) United States Patent
Kushida et al.

(10) Patent No.: US 8,448,488 B2
(45) Date of Patent: May 28, 2013

(54) FLAT WIRE MANUFACTURING METHOD OF MANUFACTURING FLAT WIRE FOR RING GEAR

(75) Inventors: Hitoshi Kushida, Kobe (JP); Osamu Ishigami, Osaka (JP); Norio Okochi, Kobe (JP); Shoji Miyazaki, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1055 days.

(21) Appl. No.: 11/755,520

(22) Filed: May 30, 2007

(65) Prior Publication Data

US 2007/0289350 A1 Dec. 20, 2007

(30) Foreign Application Priority Data

Jun. 12, 2006 (JP) ..... 2006-162623
Mar. 1, 2007 (JP) ..... 2007-051758

(51) Int. Cl.
*B21B 23/00* (2006.01)
*B21C 1/04* (2006.01)

(52) U.S. Cl.
USPC ..... 72/366.2; 72/278

(58) Field of Classification Search
USPC ..... 72/278, 282, 224, 225, 234, 235, 72/366.2; 148/595, 599
See application file for complete search history.

(56) References Cited

U.S. PATENT DOCUMENTS 5,665,179 A * 9/1997 Izawa et al. ..... 148/226
5,846,344 A * 12/1998 Kawaguchi et al. ..... 148/333
2005/0217763 A1 10/2005 Ahn
2006/0130946 A1* 6/2006 Minamida et al. ..... 148/595

FOREIGN PATENT DOCUMENTS

CN 1668773 A 9/2005
JP 64-27703 1/1989

* cited by examiner

*Primary Examiner* — Teresa M Ekiert
(74) *Attorney, Agent, or Firm* — Oblon, Spivak, McClelland, Maier & Neustadt, L.L.P.

(57) ABSTRACT

A round steel rod having a carbon content between 0.30 and 0.60% is processed by a cold working process to form a flat wire for forming a ring gear. The cold working process forms a semifinished flat wire by at least one cold rolling or cold roller drawing step and at least one two-way or four-way rolling step. The semifinished flat wire is processed by die drawing using a drawing die to obtain a finished flat wire in a last stage of the cold working process. The cold working process reduces the round steel rod at a total area reduction of 65% or below.

18 Claims, 5 Drawing Sheets

1
ϕ15mm 12 mm X 16.3 mm
P
2a
2b
2
2b
2a
P 14 mm X 12.8 mm
2b
2a
P
2
P
2a
2b 10.5 mm X 15.7 mm
P
2a
2b
2
2b
2a
P 14.5 mm X 11 mm
2b
2a
P
2
P
2a
2b
FOUR ALTERNATE THICKNESS AND WIDTH ROLLING PASSES 9 mm X 12 mm
2
2a
2b
2b
2a
DIE DRAWING

FLAT WIRE MANUFACTURING METHOD OF MANUFACTURING FLAT WIRE FOR RING GEAR

BACKGROUND OF THE INVENTION

1. Field of the Invention

The present invention relates to a flat wire manufacturing method of manufacturing a flat wire having high dimensional accuracy for forming a ring gear by processing a round rod by cold working without requiring tempering to soften the surface of the flat wire hardened by cold working.

2. Description of the Related Art

There are various flat wire manufacturing methods of manufacturing flat wires for forming ring gears and spiral wires. Those methods include a flat wire manufacturing method of manufacturing a flat wire by die drawing a hot-rolled flat wire, a flat wire manufacturing method of manufacturing a flat wire by die drawing a hot-rolled round rod, a flat wire manufacturing method of manufacturing a flat wire by cold-drawing a hot-rolled round rod and a flat wire manufacturing method of manufacturing a flat wire by hot-rolling a hot-rolled round rod.

Although the flat wire manufacturing method that produces a flat wire by processing a round rod only by a cold-rolling process or a hot-rolling process can produce the flat wire at a high productivity because the round rod can be rolled at a high rolling speed, the flat wire manufacturing method cannot produce a flat wire having a high dimensional accuracy. Flat wires produced by a hot rolling process are inferior in dimensional accuracy to those produced by a cold rolling process and need to be processed by machining processes to remove scales and to a decarburized layer. When a flat wire is produced by processing a round rod by a die drawing process, the round rod cannot fill up a drawing die 5 as shown in FIG. 6A unless the diameter of the round rod is greater than the width of the die opening of the drawing die 5. Therefore, a round rod 1 of a very large diameter as shown in FIG. 6B is needed to produce a flat wire having a high flatness. The area reduction of the round rod 1 having such a large diameter is inevitably large and the round rod 1 is broken during die drawing.

When a wide flat wire is produce by processing a round rod at a high working ratio by a cold working process, cracks are liable to be produced in the side surfaces of the flat wire. A method of manufacturing a flat wire for forming a spiral spring disclosed in JP-A 64-27703 processes side parts of the flat wire by an area reducing process to reduce the area by an area reduction in the area reduction range between 1.5 and 15% in the direction of the width of the flat wire at least once in an initial stage of cold rolling process.

The inventors of the present invention examined the area reduction range between 1.5 and 15% for the side parts of the flat wire in the direction of the width mentioned in JP-A 64-27703 through experiments. It was found that the area reduction range between 1.5 and 15% does not have direct relation with the desired hardness of a cold-drawn flat wire for a ring gear and the hardness of the flat wire for a ring wire is dependent on the total reduction of area in the cold drawing process. It was also found that the flat wire finished only by the cold drawing process mentioned in JP-A 64-27703 has low dimensional accuracy, has major surfaces and side surfaces respectively having different hardnesses, and is unsatisfactory in quality.

SUMMARY OF THE INVENTION

Accordingly, it is an object of the present invention to provide a flat wire manufacturing method capable of manufacturing a flat wire for a ring gear satisfactory in both hardness and dimensional accuracy, having a small difference between the hardness of major surfaces and that of side surfaces and not requiring tempering to soften the surface of the flat wire hardened by cold working.

A first aspect of the present invention is directed to a flat wire manufacturing method of manufacturing a flat wire for a ring gear by a cold working process including: a flat wire forming step of processing a round steel rod having a carbon content in the range of 0.30 and 0.60% by cold rolling or cold roller drawing at least once to form a semifinished flat wire; and a flat wire finishing step of finishing the entire surface of the semifinished flat wire by die drawing using a drawing die at a last stage of the cold working process; wherein a total area reduction at which the round steel rod is worked by the cold working process is, corresponding to the above carbon content, 55% or below to 65% or below.

A second aspect of the present invention is directed to the flat wire manufacturing method according to the first aspect which may include a two-way rolling step of pressing side surfaces of the semifinished flat wire in two directions parallel to the width of the semifinished flat wire at least once or a four-way rolling step of pressing the side surfaces and upper and lower surfaces of the flat wire in four directions at least once to be executed between cold rolling or cold roller drawing in the flat wire forming step and the flat wire finishing step.

A third aspect of the present invention is directed to a flat wire manufacturing method of manufacturing a flat wire for a ring gear by a cold working process including the step of finishing the entire surface of a workpiece obtained by processing a round steel rod having a carbon content in the range of 0.30 to 0.60% by a cold rolling or cold roller drawing process at least once; wherein a total area reduction at which the round steel rod is worked by the cold working process is, corresponding to the above carbon content, 55% or below to 65% or below.

A fourth aspect of the present invention is directed to the flat wire manufacturing method according to the third aspect further including the step of pressing side surfaces of the workpiece formed by the cold rolling or cold roller drawing process in the two directions parallel to the width of the semifinished flat wire at least once by a two-way rolling process or pressing the side surfaces and upper and lower surfaces of the workpiece in four directions at least once by a four-way pressing process before subjecting the workpiece to the finishing die drawing process.

FIG. 1 is a graph showing the variation of surface hardness S (HRB: Rockwell hardness B) with total area reduction Rt for flat wires formed by processing round steel rods of 15 mm in diameter respectively having different carbon contents by cold working including a flat wire forming process using cold rolling and a flat wire finishing process using a drawing die. The surface hardness S is the mean of the hardnesses of the upper or the lower surface and the side surface of the finished flat wire. It is known from FIG. 1 that the surface hardness S of the flat wire is not dependent on the processing method including cold rolling and cold drawing and is dependent on the total area reduction Rt. The surface hardness S of the finished flat wire for a ring gear needs to be HRB 105 or below in view of workability of the flat wire and avoiding developing cracks in the flat wire when the flat wire is bent in a ring to form a ring gear. It is known from FIG. 1 that a suitable total area reduction Rt in the cold working process is 65% or below for the round steel rod having a carbon content in the range of 0.30 to 0.40%, 60% or below for the round steel rod having a carbon content in the range of 0.40 to 0.50%, and 55% or below for the round steel rod having a carbon content in the range of 0.50 to 0.60%. That is, a total area reduction Rt for the round steel rods having carbon contents in the forgoing ranges needs to be in the range of 55 to 65%. Workability and machinability are important with flat wires for forming parts other than ring gears. Therefore, it is desirable to reduce the hardness of the flat wires for forming parts other than ring gear by processing the round steel rod at a total area reduction of 65% or below by the cold working process. The flat wire finished by die drawing using a drawing die has high dimensional accuracy and ranges in which the widths and thicknesses of thus finished flat wires are distributed can be narrowed. Since the flat wire is finished by die drawing at the last stage of the cold working process, increase in the drawing reduction at which the flat wire is drawn by die drawing can be reduced by the width increasing effect of cold rolling. Since the desired total area reduction is in the range of 55 to 65%, the flat wire has a comparatively low surface hardness. Therefore, the flat wire does not need to be processed by a tempering process for hardness reduction and development of cracks in the side surfaces of the flat wire can be avoided.

As shown typically in FIG. 2, when a round steel rod 1 is processed by cold rolling or cold roller drawing, the round steel rod 1 is compressed in the directions of the arrows P to form a semifinished flat wire 2 having convex side surfaces 2*b*. The drawing die to be used at the last stage of the cold working process having a drawing bore having flat side surfaces. When the semifinished flat wire 2 having the convex side surfaces 2*b* is drawn through the drawing die, parts of the side surfaces 2*b* are processed at different reduction ratios. Consequently, the condition of the side surfaces of the finished flat wire is worse than that of the upper and the lower surface of the finished flat wire. Since the convex side surfaces are flattened by reducing the width of the semifinished flat wire 2, all the surfaces of the finished flat wire can be finished in a satisfactory condition. One or both the side surfaces of some flat wires are rounded. Such a flat wire can be formed by reducing the side surfaces of the flat wire by using a groove roller.

The flat wire manufacturing method according to the present invention processes a round steel rod by cold rolling or cold roller drawing in the cold working process to form a semifinished flat, and then finishes the semifinished flat wire to obtain a finished flat wire for a ring gear by processing the semifinished flat wire by die drawing using the drawing die, wherein the total area reduction is in the range of 55 to 65% for round steel rods respectively having different carbon contents. The flat wire thus manufactured is satisfactory in dimensional accuracy, has upper and lower surfaces and side surfaces respectively having proper hardnesses distributed in a narrow hardness range, does not need to be processed by a tempering process, and can suppress the development of cracks in the side surfaces.

When the flat wire manufacturing method includes the two-way rolling step of pressing the side surfaces of the flat wire in two directions parallel to the width of the flat wire at least once or the four-way rolling step of pressing the side surfaces and upper and lower surfaces of the flat wire in four directions at least once to be executed between the flat wire forming step and the flat wire finishing step, the convex side surfaces of the semifinished flat wire can be flattened and hence all the surfaces of the flat wire can be finished in a satisfactory condition.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
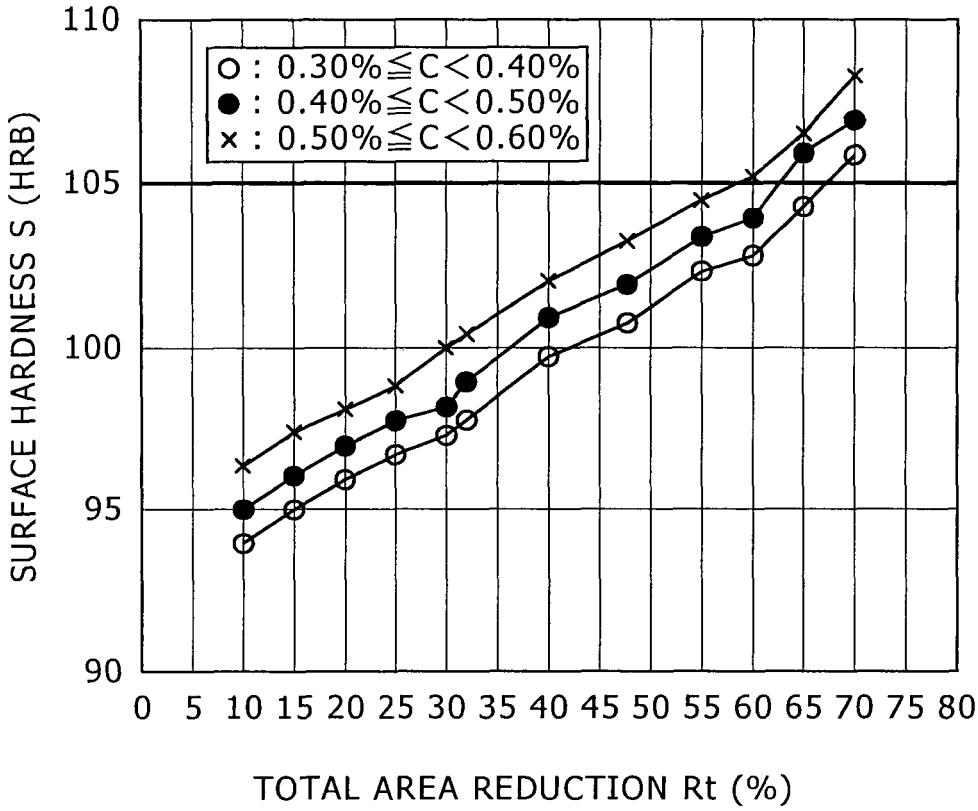
FIG. 1 is a graph of assistance in explaining the dependence of surface hardness and total area reduction at which a workpiece is processed by a cold working process.
Figure 2:
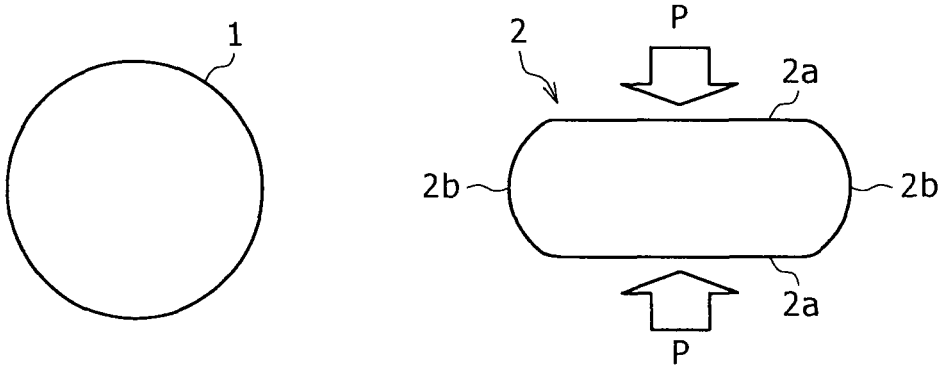
FIG. 2 is a typical end view of a round steel rod and a semifinished flat wire formed by vertically compressing the round steel rod by the cold working process.
Figure 3:
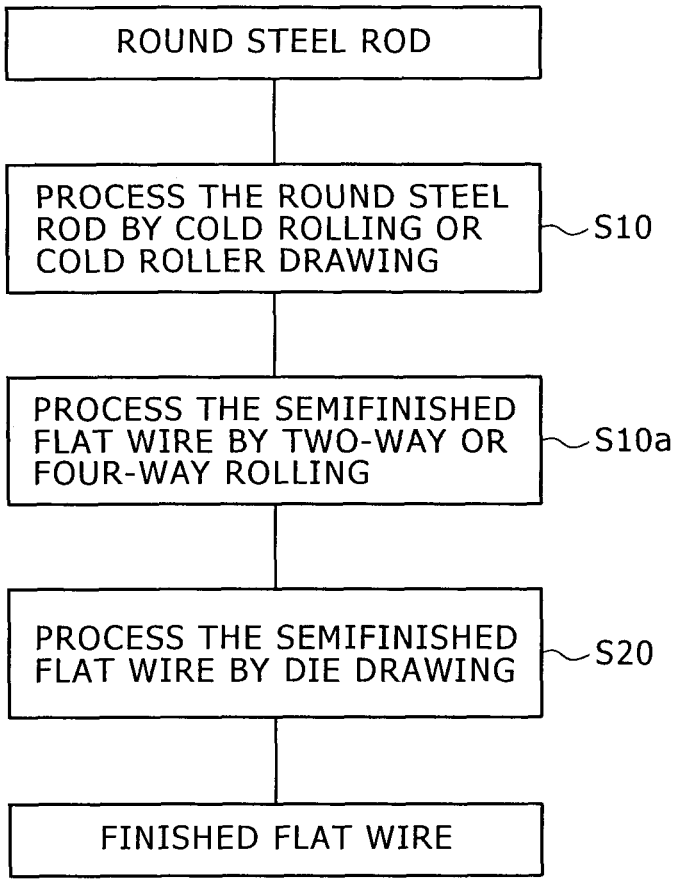
FIG. 3 is a flow chart of a cold working process included in a flat wire manufacturing method in a preferred embodiment according to the present invention.
Figures 4A, 4B, 4C, 4D, 4E:
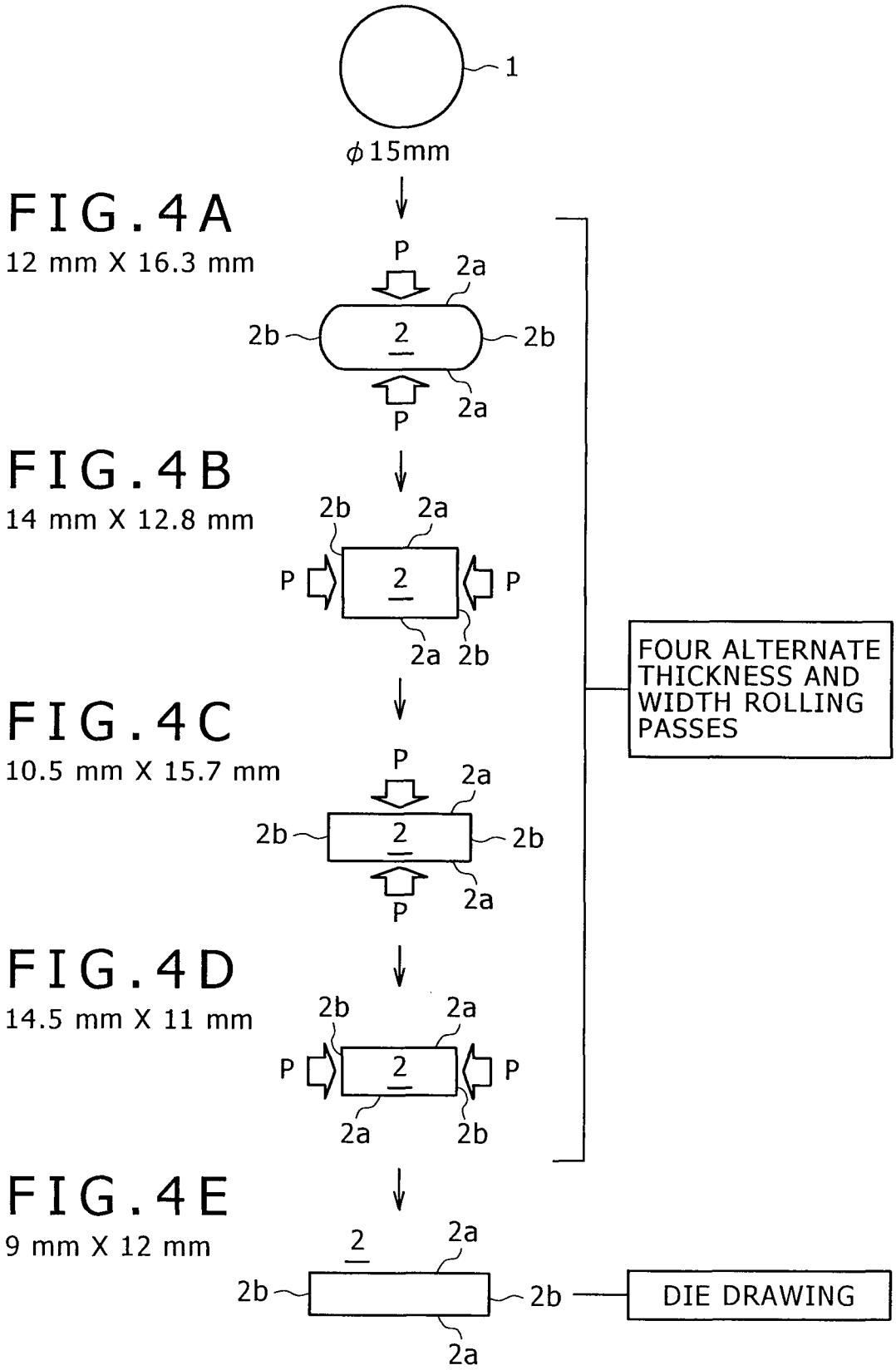
FIG. 4 is a diagrammatic view of assistance in explaining the steps of the cold working process included in the flat wire manufacturing method in the preferred embodiment.

Referring to FIG. 3, showing steps of a flat wire manufacturing method in a preferred embodiment according to the present invention using a cold working process, a round steel rod having a carbon content in the range of 0.30 to 0.60%, namely, a workpiece, is reduced gradually into a semifinished flat wire 2 (FIG. 2) by cold rolling or cold roller drawing in step S10. The semifinished flat wire 2 formed in step S10 has flat upper and lower surfaces 2*a* and convex side surfaces 2*b*. In step S10*a*, the semifinished flat wire 2 is rolled at least once in the cold working process by two-way rolling with respect to width or by four-way rolling with respect to width and thickness to flatten the convex side surfaces 2*b* of the semifinished flat wire 2. It is desirable to subject the workpiece to the two-way rolling or the four-way rolling and to the cold rolling or cold drawing alternately. The semiconductor finished flat wire 2 is finished by die drawing using a drawing die at a last stage of the cold working process to obtain a finished flat wire in step S20. The semifinished flat wire 2 is reduced at a drawing reduction in the range of 10 to 50% by drawing. Generally, a desirable drawing reduction is on the order of 30%. A proper total area reduction in the range of 55 to 65% at which the round steel rod is reduced by the cold working process including steps S10, S10*a* and S20 is selectively determined taking into consideration the carbon content of the round steel rod. Thus the finished flat wire is obtained by drawing.

EXAMPLE 1

A round steel rod 1 of 15 mm in diameter having a carbon content of 0.48% was used as a workpiece. The workpiece was processed successively by rolling passes shown in FIGS. 4A to 4D. FIGS. 4A to 4E show sectional shapes of the workpiece at the exits of the passes, respectively. The upper and the lower surface 2*a* and the side surfaces 2*b* were rolled alternately by changing the rolling directions of the successive passes through 90° A semiconductor finished flat wire 2 of 11 mm in thickness and 14.5 mm in width was obtained by the four cold rolling passes. The semifinished flat wire 2 was finished by cold die drawing using a drawing die to obtain a finished flat wire 2 of 9 mm in thickness and 12 mm in width. The total area reduction of the cold working process was about 40%. Table 1 shows the surface hardnesses (HRB) of flat wires after being processed by the four rolling passes and those of flat wires finished by one drawing pass. In Table 1, "wide surfaces" are upper and lower surfaces 2*a* of the flat wire and "narrow surfaces" are the side surfaces 2*b* of the flat wire.

TABLE 1

| Cold working process | Surface hardness (HRB) Middle point in the wide surface | Middle point in the narrow surface |
|---|---|---|
| After four rolling passes | 101 | 94 |
| After drawing | 100 | 100 |

As obvious from Table 1, the difference in hardness between a middle part of the wide surface and middle part of the narrow surface of the semifinished flat wire after the four passes of cold rolling was HRB 7. Both the respective middle parts of the wide surface and the narrow surface of the finished flat wire finished by one pass of drawing had the same hardness of HRB 100. Since the side surfaces of the workpiece were pressed in directions parallel to the width by every other one of the four passes of cold rolling, the quality of all the surfaces of the flat wire finished by drawing was satisfactory.

EXAMPLE 2

Parameters of the cold working process and total area reduction for working were adjusted to obtain flat wire of 9 mm in thickness and 12 mm width by processing round steel rods having a carbon content of 0.4%. Hardnesses, hardness dispersion, dimensional accuracy and surface quality of flat wires are shown in Table 2. The diameter of the rolling rolls of a two-way rolling mill was 270 mm. Total area reduction was changed by changing the diameters of the round steel rods. In Table 2, a circle in a column of ultimate hardness, namely, hardness of the finished flat wire, indicates a hardness of HRB 100 or below, a circle in a column of ultimate hardness dispersion indicates a difference of HRB 5 or below between the mean of hardnesses of three middle points in the side surface of the finished flat wire and the mean of hardnesses of three middle points in the upper surface (or the lower surface) of the finished flat wire, a circle in a column of dimensional accuracy indicates that the thickness and the width of the finished flat wire are within 9±0.05 mm and 12±0.05 mm, respectively, and a triangle in the column of dimensional accuracy indicates that the thickness and the width of the finished flat wire are within 9±0.10 mm and 12±0.10 mm, respectively. In the column of surface quality a double circle indicates that any irregularities were not visually found in the surface and the surface quality of the surface was very satisfactory, a circle indicates that irregularities were scarcely visually found in the surface and the surface quality of the surface was satisfactory, and a triangle indicates that some irregularities were visually found in the surface.

TABLE 2

| No. | Cold working process | Diameter of the steel rod | Number of rolling passes Thickness | Width | Total area reduction (%) | Hardness (HRB) | Hardness dispersion | Dimensional accuracy | Surface quality | Remarks |
|---|---|---|---|---|---|---|---|---|---|---|
| 1 | Only two-way | 15 | 3 | 3 | 39 | ○ | X | Δ | Δ | Comp. example |
| 2 | . . . | 16 | 3 | 3 | 46 | ○ | X | Δ | Δ | Comp. example |
| 3 | | 17 | 3 | 3 | 52 | ○ | X | Δ | Δ | Comp. example |
| 4 | Two-way | 15 | 1 | 0 | 39 | ○ | ○ | ○ | ○ | Example |
| 5 | rolling and | 16.5 | 1 | 0 | 49 | ○ | ○ | ○ | ○ | Example |
| 6 | drawing | 18.5 | 1 | 0 | 60 | ○ | ○ | ○ | ○ | Example |
| 7 | | 19.5 | 1 | 0 | 64 | X | ○ | ○ | ○ | Comp. example |
| 8 | Two-way | 15 | 1 | 1 | 39 | ○ | ○ | ○ | ◎ | Example |
| 9 | rolling, two- | 16.5 | 1 | 1 | 49 | ○ | ○ | ○ | ◎ | Example |
| 10 | way rolling and | 18.5 | 1 | 1 | 60 | ○ | ○ | ○ | ◎ | Example |
| 11 | drawing | 19.5 | 1 | 1 | 64 | X | ○ | ○ | ◎ | Comp. example |
| 12 | Two-way | 15 | 1 | 1 | 39 | ○ | ○ | ○ | ◎ | Example |
| 13 | rolling, four- | 16.5 | 1 | 1 | 49 | ○ | ○ | ○ | ◎ | Example |
| 14 | way rolling and | 18.5 | 1 | 1 | 60 | ○ | ○ | ○ | ◎ | Example |
| 15 | drawing | 19.5 | 1 | 1 | 64 | X | ○ | ○ | ◎ | Comp. example |

Figure 5:
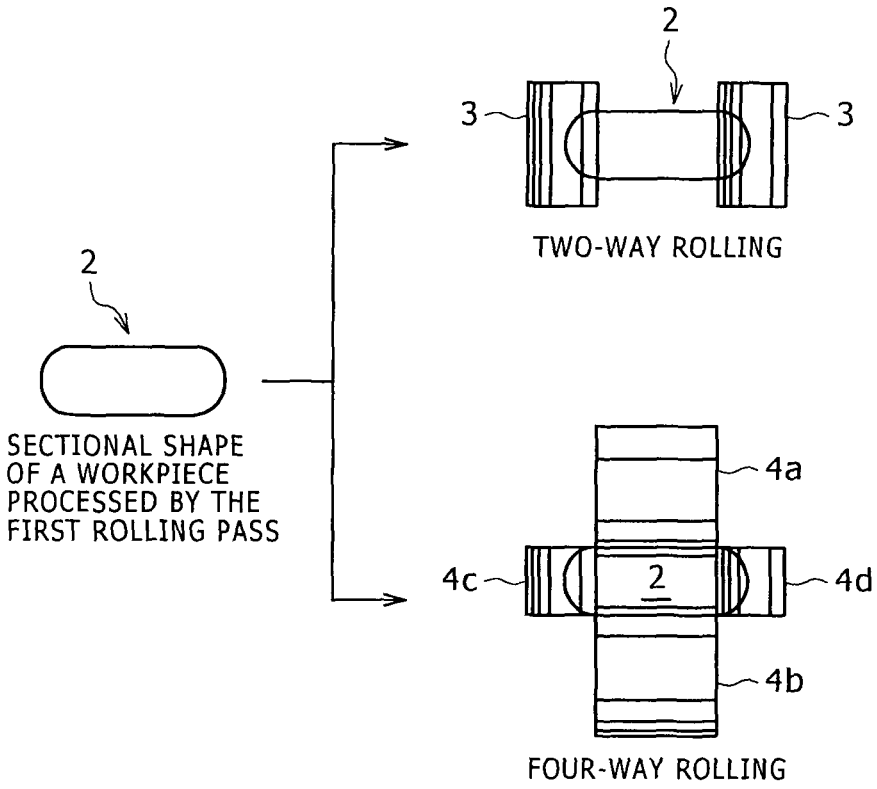
FIG. 5 is a typical view of assistance in explaining a two-way rolling step and a four-way rolling step.
Figure 6A:
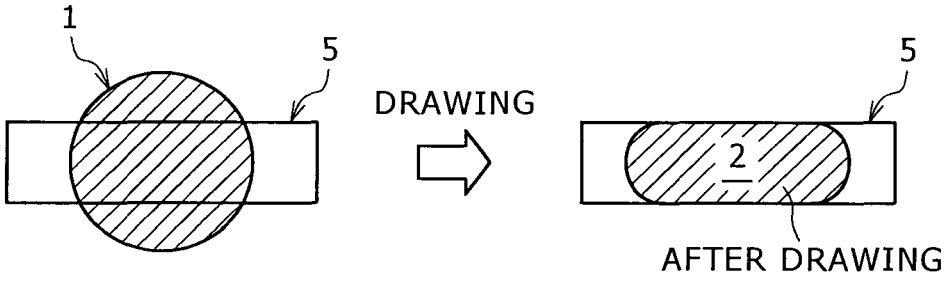
FIGS. 6*a* and 6B are typical views of assistance in explaining conditions for forming a flat wire by drawing a round steel rod.
Figure 6B:
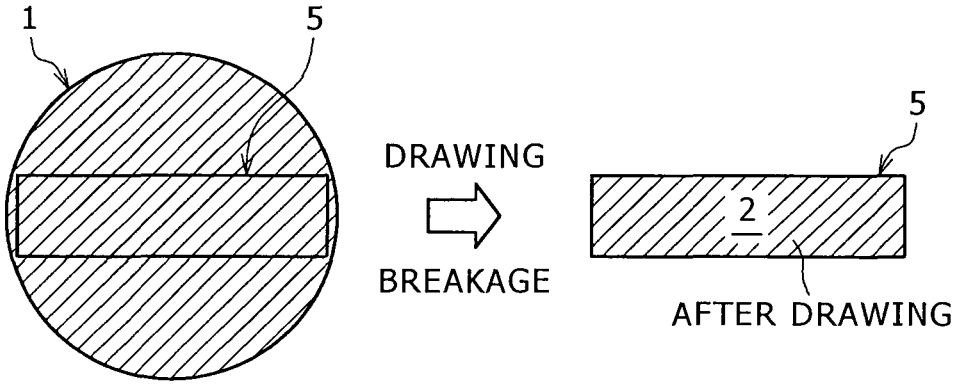

It is known from Table 2 that ranges in which hardnesses of samples Nos. 1 to 3, which were processed only by two-way rolling in the cold working process, were distributed were wider than an allowable dispersion range, and dimensional accuracy and surface quality of those samples do not meet desired dimensional accuracy and desired surface quality. Samples Nos. 4 to 7, which were processed by both cold rolling and die drawing were satisfactory in hardness, hardness dispersion, dimensional accuracy and surface quality. Samples Nos. 8 to 11 obtained by processing workpieces rolled by the first rolling pass in a shape shown in FIG. 5 by two-way rolling with respect to width using rolls 3, and samples Nos. 12 to 15 obtained by processing workpieces rolled by the first rolling pass in a shape shown in FIG. 5 by four-way rolling with respect to width and thickness using rolls 4*a*, 4*b*, 4*c* and 4*d* were particularly satisfactory in surface quality. Hardnesses of samples Nos. 4 to 7, 8 to 11 and 12 to 15, which were processed by the cold working process at total area reductions exceeding 60%, are not within a desired hardness range, and ranges in which the hardnesses of those samples were distributed are wider than a desired distribution range. Although dependent on the carbon content of the round steel rod, a desirable total area reduction is on the order of 40%, which is obvious from data on samples Nos. 4, 8 and 12. Data shown in Table 2 proves the advantageous effects of the present invention. When a flat wire having one convexly curved side surface is needed, one of the rolls 3 is a groove roll and either of the rolls 4*c* and 4*d* is a groove roll. When a flat wire having convexly curved side surfaces is needed, the rolls 3 are groove rolls and both the rolls 4*c* and 4*d* are groove rolls.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A flat wire manufacturing method of manufacturing a flat wire for a ring gear by a cold working process comprising:

a flat wire forming step of processing a round steel rod having a carbon content in the range of 0.30 and 0.60% by cold rolling or cold roller drawing at least once to form a semifinished flat wire; and a flat wire finishing step of finishing the entire surface of the semifinished flat wire by die drawing using a drawing die at a last stage of the cold working process;

wherein a total area reduction at which the round steel rod is worked by the cold working process is 40 to 65% and the surface hardness S, the mean of the hardness for the upper or the lower surface and the side surface of the finished flat wire, of the manufactured flat wire does not exceed HRB 105 (Rockwell hardness B).

2. The flat wire manufacturing method according to claim 1, wherein the cold rolling process comprises a two-way rolling step of pressing side surfaces of the semifinished flat wire in two directions parallel to the width of the semifinished flat wire at least once or a four-way rolling step of pressing the side surfaces and upper and lower surfaces of the flat wire in four directions at least once to be executed between cold rolling or cold roller drawing in the flat wire forming step and the flat wire finishing step.

3. A flat wire manufacturing method according to claim 1, wherein the total area reduction to which the round steel rod is worked by the cold working process is 55 to 65%.

4. A flat wire manufacturing method of manufacturing a flat wire for a ring gear by a cold working process comprising the step of finishing an entire surface of a workpiece obtained by processing a round steel rod having a carbon content in the range of 0.30 and 0.60% by a cold rolling or cold roller drawing process at least once;

wherein a total area reduction at which the round steel rod is worked by the cold working process is 40 to 65% and the surface hardness S, the mean of the hardness for the upper or the lower surface and the side surface of the finished flat wire, of the manufactured flat wire does not exceed HRB 105 (Rockwell hardness B).

5. The flat wire manufacturing method according to claim 4 further comprising the step of pressing side surfaces of the workpiece formed by the cold rolling or cold roller drawing process in two directions parallel to the width of the semifinished flat wire at least once by a two-way rolling process or pressing the side surfaces and upper and lower surfaces of the workpiece in four directions at least once by a four-way pressing process before subjecting the workpiece to the finishing die drawing process.

6. A flat wire manufacturing method according to claim 4, wherein the total area reduction to which the round steel rod is worked by the cold working process is 55 to 65%.

7. A method of manufacturing flat wire for a ring gear by a cold working process, which method comprises finishing the entire surface of a semifinished flatwire workpiece obtained by processing a round steel rod having a carbon content in the range of 0.30 and 0.60% by a cold rolling or cold roller drawing process, to a total area reduction percentage to which the round steel rod is worked by the cold working process such that the surface hardness S, the mean of the hardness for the upper or the lower surface and the side surface of the finished flat wire, of the manufactured flat wire does not exceed HRB 105 (Rockwell hardness B).

8. A method of manufacturing flat wire for a ring gear by a cold working process, which method comprises finishing the entire surface of a semifinished flatwire workpiece obtained by processing a round steel rod having a carbon content in the range of 0.30 and 0.60% by a cold rolling or cold roller drawing process, to a total area reduction percentage to which the round steel rod is worked by the cold working process of 40 to 55% when processing a round steel rod having a carbon content in the range of 0.50 and 0.60%, 40 to 60% when processing a round steel rod having a carbon content in the range of 0.40 and 0.50%, and 40 to 65% when processing a round steel rod having a carbon content in the range of 0.30 and 0.40% and a surface hardness S, the mean of the hardness for the upper or the lower surface and the side surface of the finished flat wire, of the manufactured flat wire not exceeding HRB 105 (Rockwell hardness B).

9. A method of manufacturing a flat wire for a ring gear by a cold working process according to claim 7 or 8, which comprises finishing the entire surface of a semifinished flatwire workpiece obtained by processing a round steel rod having a carbon content in the range of 0.30 and 0.40% by a cold rolling or cold roller drawing process, to a total area reduction percentage to which the round steel rod is worked by the cold working process of 40 to 65%.

10. A method of manufacturing a flat wire for a ring gear by a cold working process according to claim 7 or 8, which comprises finishing the entire surface of a semifinished flatwire workpiece obtained by processing a round steel rod having a carbon content in the range of 0.40 and 0.50% by a cold rolling or cold roller drawing process, to a total area reduction percentage to which the round steel rod is worked by the cold working process of 40 to 60%.

11. A method of manufacturing a flat wire for a ring gear by a cold working process according to claim 7 or 8, which comprises finishing the entire surface of a semifinished flatwire workpiece obtained by processing a round steel rod having a carbon content in the range of 0.50 and 0.60% by a cold rolling or cold roller drawing process, to a total area reduction percentage to which the round steel rod is worked by the cold working process of 40 to 55%.

12. The flat wire manufacturing method according to claim 7 or 8, wherein (1) the side surfaces of the semifinished workpiece formed by the cold rolling or cold roller drawing process are pressed in two directions parallel to the width of the semifinished flat wire at least once by a two-way rolling process, or (2) the side surfaces and upper and lower surfaces of the semifinished workpiece formed by the cold rolling or cold roller drawing process are pressed in four directions parallel to the width of the semifinished flat wire at least once by a four-way pressing process, before subjecting the workpiece to the finishing die drawing process.

13. A method of manufacturing a flat wire for a ring gear by a cold working process, which method comprises:

processing a round steel rod having a carbon content in the range of 0.30 and 0.60% by cold rolling or cold roller drawing at least once to form a semifinished flat wire; and finishing the entire surface of the semifinished flat wire by die drawing using a drawing die at a last stage of the cold working process to form a finished flat wire;

wherein a total area reduction percentage to which the round steel rod is worked by the cold working process is such that the surface hardness S, the mean of the hardness for the upper or the lower surface and the side surface, of the finished flat wire does not exceed HRB 105 (Rockwell hardness B).

14. A method of manufacturing a flat wire for a ring gear by a cold working process, which method comprises:

processing a round steel rod having a carbon content in the range of 0.30 and 0.60% by cold rolling or cold roller drawing at least once to form a semifinished flat wire; and finishing the entire surface of the semifinished flat wire by die drawing using a drawing die at a last stage of the cold working process to form a finished flat wire;

wherein a total area reduction percentage to which the round steel rod is worked by the cold working process is 40 to 55% when processing a round steel rod having a carbon content in the range of 0.50 and 0.60%, 40 to 60% when processing a round steel rod having a carbon content in the range of 0.40 and 0.50%, and 40 to 65% when processing a round steel rod having a carbon content in the range of 0.30 and 0.40%.

15. The method of manufacturing a flat wire for a ring gear by a cold working process according to claim 13 or 14, which method comprises:

processing a round steel rod having a carbon content in the range of 0.50 and 0.60% by cold rolling or cold roller drawing at least once to form a semifinished flat wire; and finishing the entire surface of the semifinished flat wire by die drawing using a drawing die at a last stage of the cold working process to form a finished flat wire;

wherein a total area reduction percentage to which the round steel rod is worked by the cold working process is 40 to 55%.

16. The method of manufacturing a flat wire for a ring gear by a cold working process according to claim 13 or 14, which method comprises:

processing a round steel rod having a carbon content in the range of 0.40 and 0.50% by cold rolling or cold roller drawing at least once to form a semifinished flat wire; and finishing the entire surface of the semifinished flat wire by die drawing using a drawing die at a last stage of the cold working process to form a finished flat wire;

wherein a total area reduction percentage to which the round steel rod is worked by the cold working process is 40 to 60%.

17. The method of manufacturing a flat wire for a ring gear by a cold working process according to claim 13 or 14, which method comprises:

processing a round steel rod having a carbon content in the range of 0.30 and 0.40% by cold rolling or cold roller drawing at least once to form a semifinished flat wire; and finishing the entire surface of the semifinished flat wire by die drawing using a drawing die at a last stage of the cold working process to form a finished flat wire;

wherein a total area reduction percentage to which the round steel rod is worked by the cold working process is 40 to 65%.

18. The flat wire manufacturing method according to claim 13 or 14, wherein the cold rolling process comprises a two-way rolling step of pressing side surfaces of the semifinished flat wire in two directions parallel to the width of the semifinished flat wire at least once or a four-way rolling step of pressing the side surfaces and upper and lower surfaces of the flat wire in four directions parallel to the width of the semifinished flat wire at least once between the cold rolling or cold roller drawing of the flat wire forming step and the flat wire finishing step.

* * * * *